US006213921B1

(12) United States Patent
Frey

(10) Patent No.: US 6,213,921 B1
(45) Date of Patent: Apr. 10, 2001

(54) LIGHT WEIGHT EXERCISE APPARATUS

(76) Inventor: Mark P. Frey, 2 Hewlett Rd., New Fairfield, CT (US) 06812

( * ) Notice: Subject to any disclaimer, the term of this patent is extended or adjusted under 35 U.S.C. 154(b) by 0 days.

(21) Appl. No.: 09/414,382

(22) Filed: Oct. 7, 1999

Related U.S. Application Data

(62) Division of application No. 09/023,156, filed on Feb. 12, 1998, now Pat. No. 6,001,049.

(51) Int. Cl.[7] ..... A63B 21/065
(52) U.S. Cl. ..... 482/105; 482/93
(58) Field of Search ..... 482/44, 49, 50, 482/105, 106–109, 93; 602/20, 21

(56) References Cited

U.S. PATENT DOCUMENTS

| | | | | |
|---|---|---|---|---|
| 315,512 | | 4/1885 | Kearns . | |
| 707,356 | | 6/1902 | Calvert . | |
| 1,328,598 | | 1/1920 | Schilling . | |
| 1,469,315 | | 10/1923 | Hansard . | |
| 1,797,057 | | 3/1931 | Foulke . | |
| 2,617,650 | | 11/1952 | Landis . | |
| 2,693,794 | | 11/1954 | Neville . | |
| 3,185,476 | | 5/1965 | Fechner | 482/50 X |
| 3,369,258 | | 2/1968 | Smith | 402/105 |
| 4,109,908 | | 8/1978 | Pugh et al. . | |
| 4,231,569 | | 11/1980 | Rae . | |
| 4,247,097 | | 1/1981 | Schwartz . | |
| 4,312,506 | * | 1/1982 | Brennan | 482/106 |
| 4,326,706 | | 4/1982 | Guthrie et al. | 482/105 |
| 4,327,908 | * | 5/1982 | James | 482/106 |
| 4,330,120 | | 5/1982 | Netti . | |
| 4,345,756 | | 8/1982 | Hoagland . | |
| 4,484,740 | | 11/1984 | Green . | |
| 4,585,228 | | 4/1986 | Olsen . | |
| 4,607,840 | | 8/1986 | Harper . | |
| 4,684,122 | | 8/1987 | Desmond et al. . | |
| 4,722,523 | | 2/1988 | Yang . | |
| 4,798,199 | | 1/1989 | Hubbard et al. | 128/87 R |
| 4,858,916 | | 8/1989 | Beaumont | 482/105 |
| 4,896,880 | | 1/1990 | Caruthers | 482/108 |
| 4,943,052 | | 7/1990 | Powers . | |
| 4,949,957 | | 8/1990 | Cucchiara . | |
| 4,964,631 | | 10/1990 | Marano . | |
| 5,058,576 | | 10/1991 | Grim et al. | 128/87 R |
| 5,110,119 | | 5/1992 | Arnold | 482/93 |
| 5,113,849 | | 5/1992 | Kuiken et al. | 128/26 |
| 5,302,165 | | 4/1994 | Caruthers | 482/108 |
| 5,350,345 | | 9/1994 | Frey | 482/105 |
| 5,569,124 | | 10/1996 | Raynie et al. | 482/44 |
| 5,667,466 | | 9/1997 | Riley | 482/44 X |

FOREIGN PATENT DOCUMENTS

| | | |
|---|---|---|
| 217608 | 2/1909 | (DE) . |
| 0116670 | 4/1983 | (EP) . |

* cited by examiner

*Primary Examiner*—John Mulcahy
(74) *Attorney, Agent, or Firm*—Robin, Blecker & Daley

(57) ABSTRACT

A light weight exercise apparatus includes a support including a first part extending along a portion of the lower arm of the user and a second part extending from the first part and having first and second portions. The first portion is an outwardly curved portion for supporting the wrist and hand of the user and the second portion is a portion extending downward and outward from the first portion to form a retaining portion for further supporting and substantially surrounding the hand of the user. The retaining portion further includes a grip portion attached to and extending across the width of the retaining portion to be gripped by the hand of the user.

5 Claims, 4 Drawing Sheets

LIGHT WEIGHT EXERCISE APPARATUS

This application is a division of U.S. appln Ser. No. 09/023,156, filed Feb. 12, 1998, now U.S. Pat. No. 6,001,049.

FIELD OF THE INVENTION

This invention relates generally to exercise apparatuses, and pertains more particularly to a light weight exercise apparatus for use in exercising a user's arm musculature.

BACKGROUND OF THE INVENTION

Different types of light weight exercise apparatuses have been designed over the years for exercising various areas of a user's arm. Particularly, hand-held apparatuses that totally surround a user's hand or that provide a straight support just for the user's wrist have been developed in order to strengthen a user's hand, wrist area, forearm or upper arm during exercise.

For example, U.S. Pat. No. 3,347,240 (" 'the Rigler patent") describes a heated hand exerciser in the form of a straight shell that encloses the individual's hand and a portion of the forearm. Electrical heating coils are wrapped around the shell to maintain the hand or arm in heated surroundings. A compressible handgrip is located inside of the exerciser that the user grips to perform a kneading action in order to exercise the user's hand in a heated environment.

U.S. Pat. No. 4,858,916 (" 'the Beaumont patent") describes another type of exercise apparatus in which a flat platform is used to support the lower arm and wrist of a user. A strap secures the user's arm to the platform and a gripping bar at the end of the platform is provided for gripping by the user's hand. A series of coaxially aligned adjustable weights are supported by a post positioned on the side of the platform opposite the gripping bar for alignment of the weights to the user's hand. This maintains a desired center of gravity proximate to the gripping bar and concentrates the exertion by the user during exercise.

Although the above described exercise apparatuses provide some means for exercising a user's arm musculature, exercise apparatuses that can be used during light weight exercise and provide maximum muscular contraction and extension are desired.

It is, therefore, an object of the present invention to provide an exercise apparatus that provides proper placement of a user's hand and wrist during light weight exercise.

It is an additional object of the present invention to provide an exercise apparatus that is simple in design, easy to use, economical to manufacture and low in cost.

SUMMARY OF THE INVENTION

In accordance with the principles of the present invention, the above and other objectives are realized in a light weight exercise apparatus that includes a support including a first part extending along a portion of the lower arm of the user and a second part extending from the first part and having first and second portions. The first portion is an outwardly curved portion for supporting the wrist and hand of the user and the second portion is a portion extending downward and outward from the first portion to form a retaining portion for further supporting and substantially surrounding the hand of the user. The retaining portion further includes a grip portion attached to and extending across the width of the retaining portion to be gripped by the hand of the user.

As illustrated in the embodiments, the retaining portion is a cup or trough-shaped structure that provides support for the user's hand and additional weight for the apparatus. As shown in further embodiments, the retaining portion can also be modified to include a cavity for accommodating material so that more weight can also be added to the exercise apparatus or to include a slot or aperture for permitting a portion of the user's hand to extend through the wall of the retaining portion.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

FIGS. 1–5 show an exercise apparatus 10 in accordance with the principles of the present invention. In accordance with the present invention, the exercise apparatus 10 is a small light weight exercise apparatus that can be used for toning and exercising the user's arm. Indeed, the light weight and portability of the apparatus 10 allows the user to exercise just with the apparatus or use the apparatus as an additional exercise element during an aerobic workout.

Figure 1:
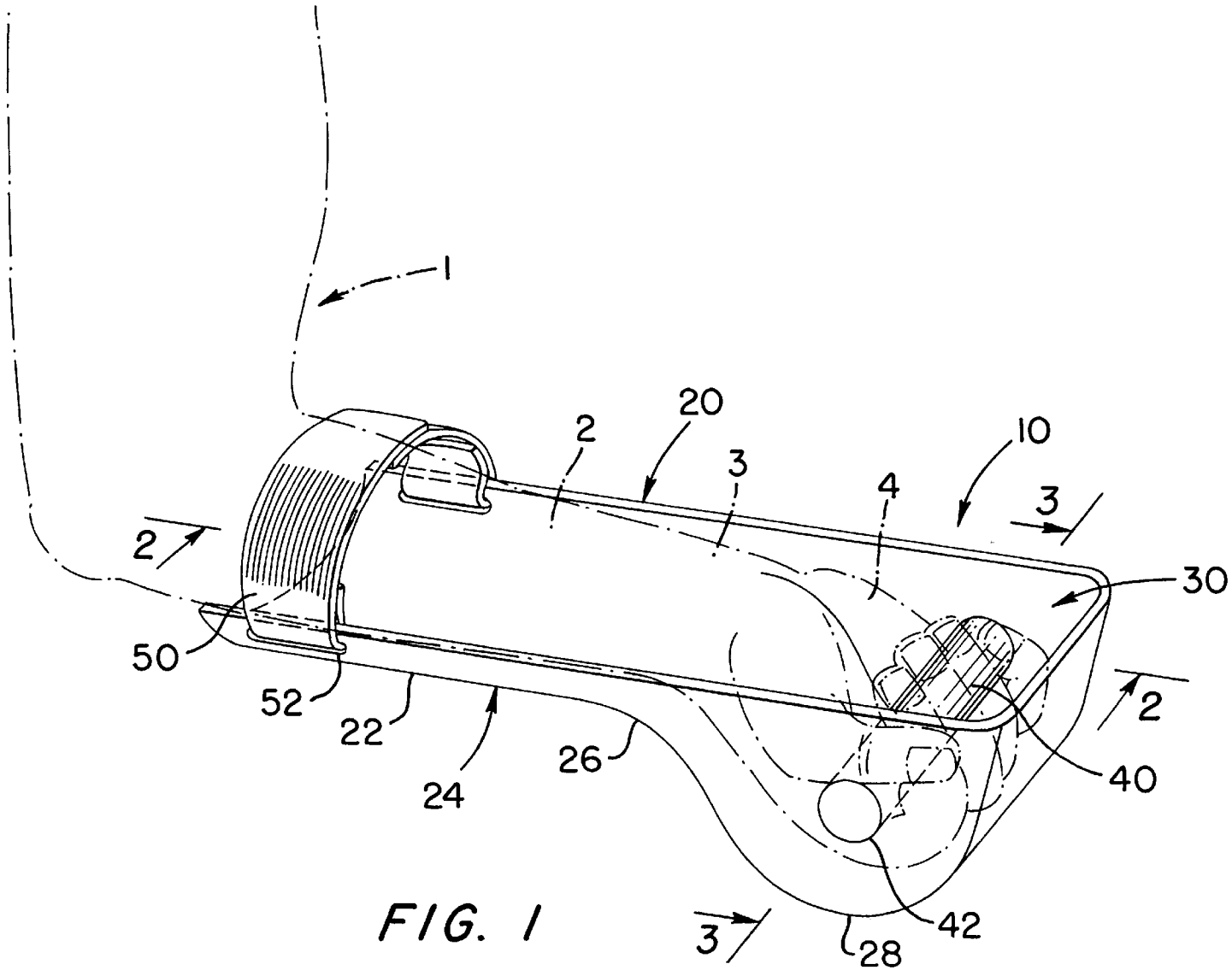
FIG. 1 shows a perspective view of an exercise apparatus of the present invention.

As shown in FIG. 1, the exercise apparatus 10 comprises an elongated support 20 which has a first part 22, shown as substantially straight, which extends along the lower arm 2 of a user 1. The support 20 further includes a second part 24 which has a first portion 26 for supporting the wrist 3 and hand 4 of the user and a second portion 28 that further supports and substantially surrounds the user's hand and is adapted to retain weight means therein.

Figure 2:
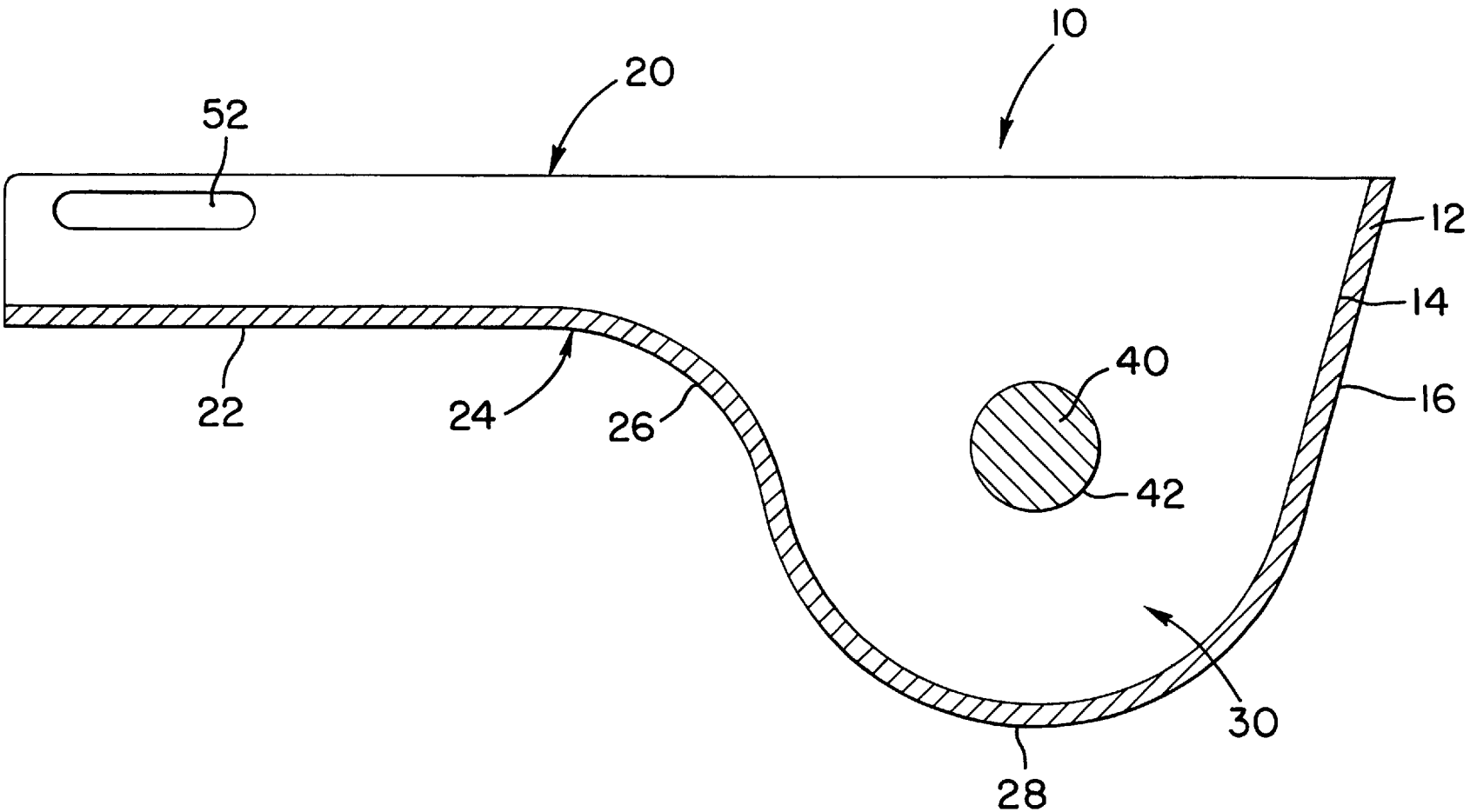
FIG. 2 shows a cross-sectional view of the exercise apparatus of FIG. 1 along the line 2—2 of FIG. 1.

As shown in FIGS. 1 and 2, the first portion 26 of the second part 24 is curved or bent outwardly so that the wrist of the user is flexed outwardly when supported in the exercise apparatus 10. The forward end of the outwardly curved portion 26 provides support for the user's hand. The second portion or retaining portion 28 extends downward and outward and substantially around the user's hand 4, i.e., around all the surfaces of the hand when clenched in a fist except the palm and upper parts of the fingers, to also support the user's hand in its cup or trough-shaped structure. The retaining portion 28 also provides added weight to the exercise apparatus 10 based upon its cup or trough-like structure. Gripping means or a grip portion 40 that is gripped by the user's hand is positioned in a hollow portion 30 defined by the retaining portion 28.

To hold the exercise apparatus 10 to the user's arm, attachment means or a strap 50 as shown in FIG. 1 are used so as to secure the apparatus 10 to the user's arm. The strap 50 passes through slots 52 formed in the arm support part 22 of the support 20 and is secured to the arm of the user by some type of engaging means, such as hooks, fasteners or the like. Other forms of attachment means, such as bindings, ties, clamps or the like may also be used.

Figure 3:
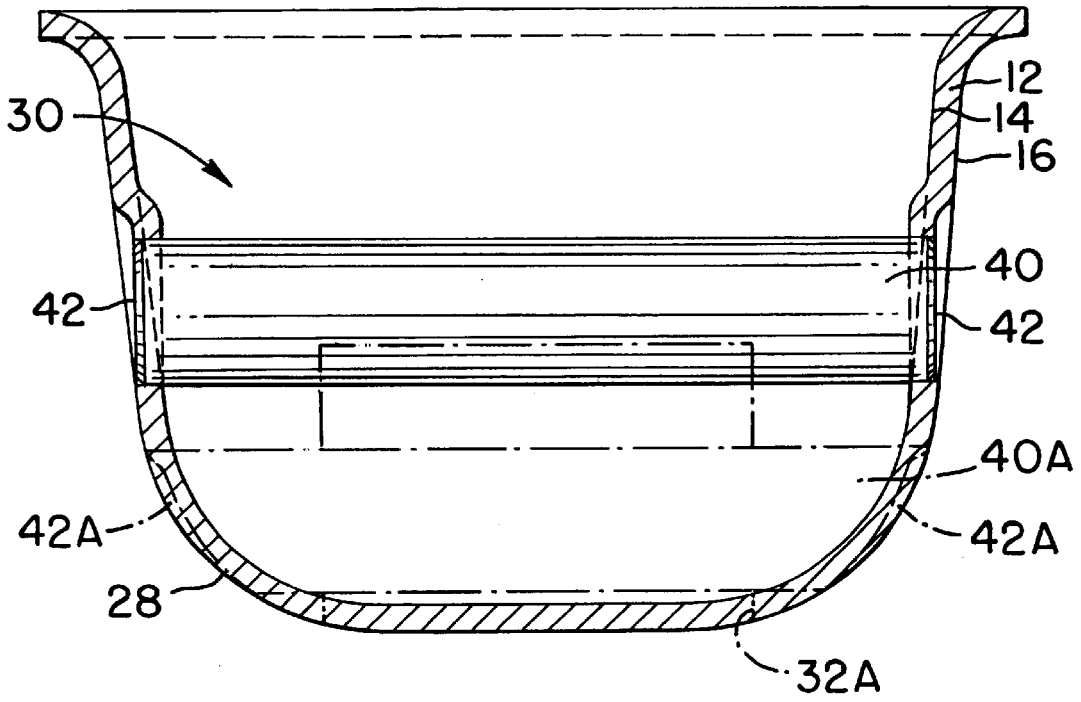
FIG. 3 shows a cross-section view of the exercise apparatus of FIG. 1 along the line 3—3 of FIG. 1.

As previously noted, the grip portion 40 is positioned in the retaining portion 28 of the apparatus 10. As shown in FIGS. 1–3, the grip portion 40, extending across the width of the retaining portion 28, is inserted in opposite apertures 42 in the retaining portion 28 for gripping by the user's hand and to help maintain extension of the wrist during exercise. The grip portion 40, however, can also be secured in the retaining portion 28 through any type of securing means or engaging means, such as, for example, recesses, indentions, adhesive, fasteners, bolts, or the like. The grip portion 40 can also be formed with the retaining portion 28 to produce the exercise apparatus 10 as a one piece unit.

Based upon the structure of the apparatus 10, the contour and length of the outwardly curved portion 26, the positioning of the grip portion 40 in the retaining portion 28 and the contour and shape of the retaining portion 28, such helps to place the wrist 3 of the user when supported in the apparatus 10 in a substantially maximum outwardly bent condition. Although the exercise apparatus 10 as illustrated in FIGS. 1–3 is for light weight exercise, exercise benefits are still obtained due to the extension of the wrist 3 along the wrist support portion 26 and the placement of the hand 4 in the retaining portion 28. This placement causes substantially full extension of the wrist 3 and, as a result, provides maximum contractions, extension and reflection of the user's arm musculature when the user moves his or her forearm up and down, i.e., curls, with the exercise apparatus 10.

Figure 4:
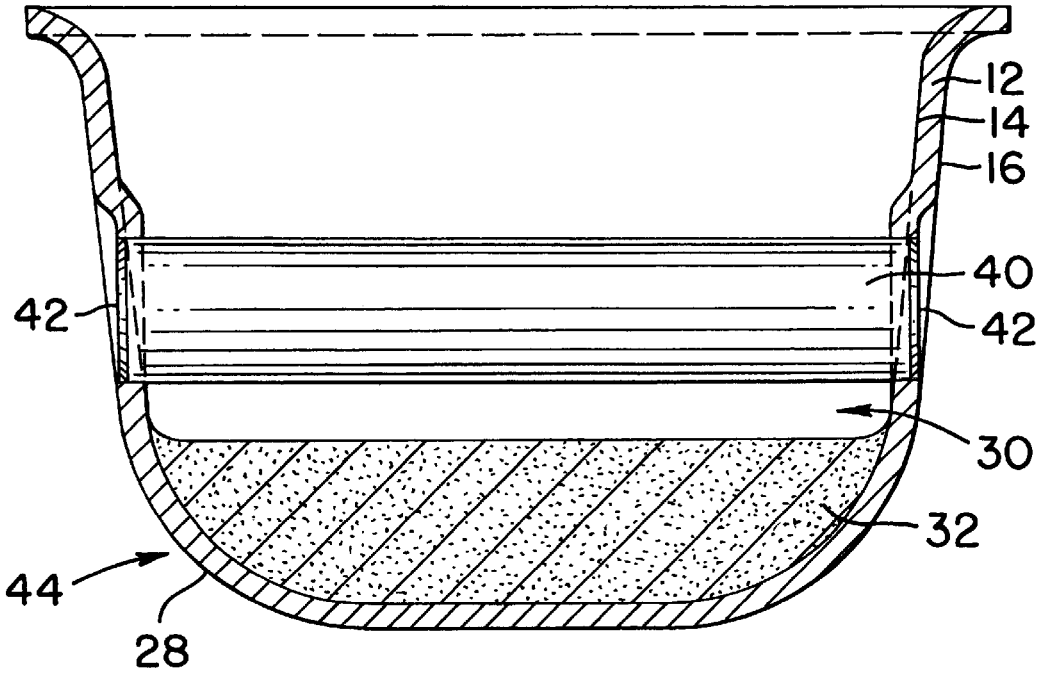
FIG. 4 shows a cross-section view of another embodiment of the exercise apparatus of the present invention along the line 3—3 of FIG. 1.

A greater effect, however, can be realized when further weight is placed in the retaining portion 28 of the apparatus 10. As illustrated in FIG. 4, the retaining portion 28 can extend to a depth beyond that needed to accommodate the user's hand to define a cavity 32 in its bottom portion 44 that is bordered by the inner surface of the wall 12 of the apparatus 10. This cavity 32 is adaptable to accommodate additional weight. The cavity 32 can accordingly be filled with any type of material, e.g., sand, foam, gel, plastic, metal or the like filler material, to increase the weight of the apparatus 10 thereby enhancing the user's workout.

The apparatus 10, however, is also not limited to having a cavity only in the retaining portion 28 but can also have a cavity, similar to the cavity 32 as shown in FIG. 4, extend throughout or in particular sections of the apparatus 10. Such a hollow cavity filled with material could also provide additional weight to the apparatus 10. As another example, a cavity could be created in the wall 12 of the apparatus between its inner and outer surfaces 14 and 16. This cavity could also be filled with some type of material to also increase the weight of the apparatus 10.

Figure 5:
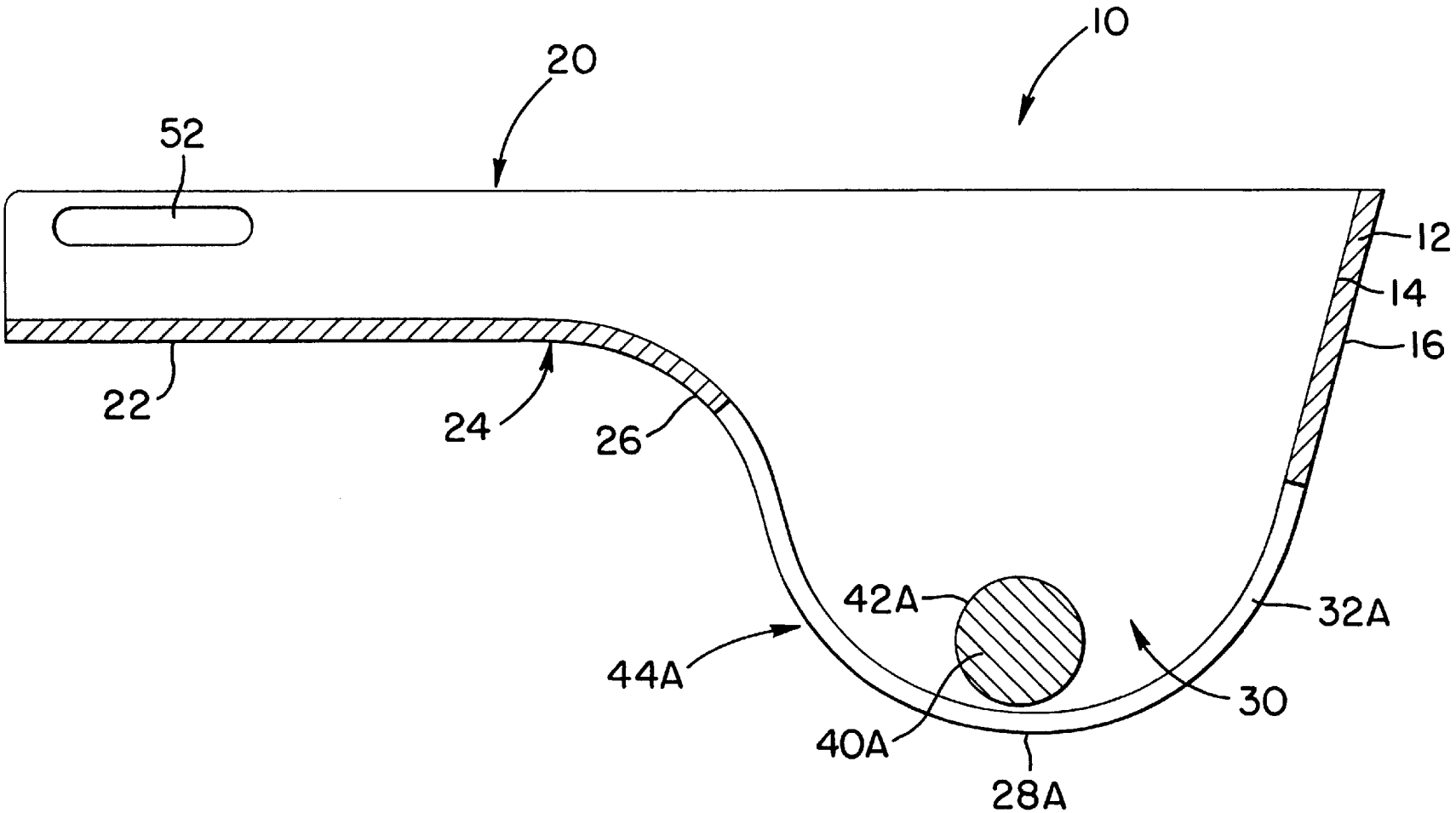
FIG. 5 shows a cross-sectional view of another embodiment of the exercise apparatus of the present invention along the line 2—2 of FIG. 1.

A further embodiment of the exercise apparatus 10 is also shown in FIG. 5 in which the retaining portion includes an aperture or open slot 32A that permits the user's hand to extend through the wall 12 of the apparatus 10. The open slot 32A extends substantially across the width of the retaining portion (as shown by ghosted lines in FIG. 3) and substantially from slightly beyond where the curved portion 26 begins to curve through to the bottom portion 44A of the retaining portion 28A. The retaining portion 28A and the slot 32A, however, are not limited to the illustrated embodiments as shown, but may be any shape or configuration, as needed, to accommodate the user's hand as well as provide weight for the apparatus. As also illustrated in FIG. 5, a grip portion 40A extends across the retaining portion 28A and the slot 32A and attaches to the retaining portion 28A through apertures 42A (as shown by ghosted lines in FIG. 3).

As illustrated in the embodiment of FIG. 1, the apparatus 10 is secured to the lower arm of the user with the apparatus 10 extending along the underside of the lower arm of the user and curls downward and outward to form the retaining portion 28. The user's hand slides under and grasps the grip portion 40 which extends between the apertures 42.

With the exercise apparatus 10 attached to the lower arm of the user 1, the arm of the user is first held in a fully extended down position. The user then curls the arm so that the hand 4 and lower arm 2 are brought up and toward the chest. The user then with a steady motion uncurls the arm to lower the hand 4 and the lower arm 2 downward and away from the body. During these motions, the user's wrist 3 remains outwardly bent and fully extended due to the outwardly curved portion of the support part. As a result, maximum exertion of the user's arm musculature occurs. However, the user is not limited to just this type of exercise with the apparatus 10, but can perform other types of exercises with the apparatus 10 depending upon the user's needs.

It will be appreciated that the exercise apparatus 10 is not limited to the illustrated embodiments but can be a variety of sizes depending on the size of the user and weight desired for the apparatus 10 itself. In addition, the exercise apparatus 10 can be any type of material, e.g., metal, wood, plastic, polycarbonate material or the like rigid material that can be used for light weight exercise. Furthermore, the grip portion 40 positioned in the retaining portion 28 which the user grasps during exercise also provides weight in the apparatus 10 and can be varied as well so as to be any type of desired material and/or weight. The grip portion 40 could also be extended through the apertures 42 so that additional weight can be added to the apparatus 10 for a more strenuous workout.

The retaining portion 28 of the exercise apparatus 10 of the present invention is also not limited to the illustrated embodiments as shown but may be a variety of forms and shapes that substantially surround the user's hand so as to provide some form of support and weight for the apparatus 10. The retaining portion 28 may also have structure that permits retention or incorporation of weight therein.

In all cases it is understood that the above-described arrangements are merely illustrative of the many possible specific embodiments which represent applications of the present invention. For example, the exercise apparatus 10 is contemplated as a solid structure but can also be separate elements that combine to form the apparatus. Numerous and varied other configurations, such as a hollow or partially hollow structure that can be formed by a variety of means can be readily devised in accordance with the principles of the present invention without departing from the spirit and scope of the invention.

What is claimed is:

1. A light weight exercise apparatus comprising:

a support including a first part for extending along a portion of the lower arm of a user and a second part extending from the first part and having first and second portions, said first portion is an outwardly curved portion for supporting the wrist of the user and said second portion is a portion extending downward, outward and upward from the first portion to form a retaining portion, said retaining portion including an aperture in a bottom portion of the retaining portion for permitting the user's hand to extend through a wall in the bottom portion of the retaining portion, said retaining portion including gripping means attached to and extending across the width of the retaining portion to be gripped by the hand of the user.

2. An apparatus in accordance with claim 1, wherein said aperture extends substantially across the width of the retaining portion and substantially from slightly beyond where the curved portion begins to curve through to a bottom portion of the retaining portion.

3. An apparatus in accordance with claim 2, wherein said gripping means comprises a grip portion having first and second ends that attach to the wall of the retaining portion and provides weight for the apparatus.

4. An apparatus in accordance with claim 3, wherein the wall of the retaining portion includes first and second apertures, said first and second ends of the grip portion being secured in the first and second apertures, respectively.

5. An apparatus in accordance with claim 4, further comprising a strap attached to said first part of said support for holding said support to said lower arm of said user.

* * * * *